US007565769B2

(12) United States Patent
Monahan et al.

(10) Patent No.: US 7,565,769 B2
(45) Date of Patent: Jul. 28, 2009

(54) METHOD OF INSTALLING SAFETY GATE AND SAFETY GATE FOR PRACTICING SAID METHOD

(76) Inventors: Robert Monahan, 371 Liberty St., Norwell, MA (US) 02576; Brian Hotaling, One Post Office Square, Acton, MA (US) 01726

( * ) Notice: Subject to any disclaimer, the term of this patent is extended or adjusted under 35 U.S.C. 154(b) by 240 days.

(21) Appl. No.: 11/608,814

(22) Filed: Dec. 9, 2006

(65) Prior Publication Data

US 2007/0131921 A1 Jun. 14, 2007

Related U.S. Application Data

(60) Provisional application No. 60/748,767, filed on Dec. 9, 2005.

(51) Int. Cl.
*E06B 3/68* (2006.01)

(52) U.S. Cl. ..... 49/57; 49/50; 49/55; 49/394; 49/395; 49/463

(58) Field of Classification Search ..... 49/50, 49/55, 57, 463, 394, 395
See application file for complete search history.

(56) References Cited

U.S. PATENT DOCUMENTS

| | | | | | |
|---|---|---|---|---|---|
| 3,172,168 | A * | 3/1965 | Suska | 49/400 |
| 4,394,805 | A * | 7/1983 | Napper | 49/55 |
| 4,677,791 | A * | 7/1987 | Larson et al. | 49/463 |
| 5,457,914 | A * | 10/1995 | Johnson, Jr. | 49/463 |
| 5,657,809 | A * | 8/1997 | Longoria et al. | 160/369 |
| 5,797,218 | A * | 8/1998 | Holland | 49/55 |
| 6,016,629 | A * | 1/2000 | Sylvester et al. | 49/55 |
| 6,112,460 | A * | 9/2000 | Wagnitz | 49/55 |
| 6,178,694 | B1 * | 1/2001 | Wagnitz | 49/55 |
| 7,322,153 | B2 * | 1/2008 | Nitz et al. | 49/57 |
| 2002/0007597 | A1 * | 1/2002 | Wang | 49/463 |
| 2003/0009945 | A1 * | 1/2003 | Cheng | 49/57 |
| 2009/0044450 | A1 * | 2/2009 | Hallman | 49/50 |

* cited by examiner

*Primary Examiner*—Katherine W Mitchell
*Assistant Examiner*—Jeff Tang
(74) *Attorney, Agent, or Firm*—Mai Pare

(57) ABSTRACT

The present invention relates to a method of installing a safety gate system whereby builders install in new construction multiple adapter features capable of attachment to specialized units that allow a user to create a gate across a passageway without the use of tools or hardware. The present invention also teaches a safety gate system for practicing said method.

2 Claims, 8 Drawing Sheets

METHOD OF INSTALLING SAFETY GATE AND SAFETY GATE FOR PRACTICING SAID METHOD

This application claims a priority date of Dec. 9, 2005 based on provisional application No. 60/748,767.

BACKGROUND OF THE INVENTION

1. Field of Invention

The present invention relates to a novel method for installing a safety gate system and a safety gate system for practicing said method. The safety gate system is intended limit access across a passageway such as a stairway, hallway, doorframe, or other enclosed area. Safety gates are generally used in households with young children to restrain them within a designated area or protect them from dangerous areas such as stair landings.

2. Description of Related Art

Temporary gate systems are commonly used in households with young children or pets for safety and supervision purposes. Gate systems can be used to keep children or pets away from selected rooms or areas or to ensure that children or pets remain within a selected room or area. Such devices are also frequently used to prevent access to stair landings or other areas dangerous to infants and toddlers.

Users of such gate systems often have two requirements: 1) users require gate systems that securely prevent access to designated areas and can withstand attempts of removal and/or entry by infants, toddlers or pets and 2) barriers should be easy and convenient to assemble.

Prior art gate systems are usually fastened to support structures by one of two means: either through pressure-mounted systems or by physical attachment to support structures through attachment means such as screws and anchors.

The pressure-mounted systems require placing a gate device within the desired location, and extending and fixing the gate horizontally to the point of compression, until it is held in place. Pressure-mounted systems typically have rubber pads to increase friction against the support structure thereby improving the stability of the system. While pressure-mounted systems may not require tools for assembly, they are often time consuming and limited as to the spaces in which they are appropriate for use.

U.S. Pat. No. 5,457,914 titled "Safety Gate for Juveniles with Security Brackets" discloses such a pressure-mounted device. A disadvantage of pressure-mounted systems such as U.S. Pat. No. 5,457,914 is that they do not provide the necessary stability required to prevent entry to areas dangerous to infants and toddlers such as the top of stair landings.

An alternative mechanism for securing a gate system in place is by hardware attached systems. In such a system, a gate is hinged to a frame, which is physically attached to a support structure through screws or other attachment means. On the opposite side of the support structure, a means to receive the gate is attached to the support structure also through screws or other attachment means.

While such hardware-attached systems are more securely fastened to support structures when compared to pressure-mounted systems, they generally require drilling holes and damaging support structures. Purchasers of such systems are required to handle the installation of such systems themselves, and may not have the necessary tools or skills to do so correctly. Furthermore, these systems require that the installer identify the location of support members within the support structure because standard sheet rock alone is insufficient to hold such systems in place. Manufacturers of such systems recommend that such systems be attached to parallel, wooden wall surfaces which can be impractical since such wall surfaces may not be present in the desired location.

An additional disadvantage of most prior art hardware-attached systems is once installed, they are not convenient to uninstall. If the user wishes to remove the barrier component of such gate systems, damaged support structures are exposed. If a user temporarily has no need for the gate system but anticipates a need for it in the future, he is likely to keep the gate in place, despite any inconvenience of having the barrier in position.

Finally, a major shortcoming of all of the prior art is that significant time, tools, or hardware is required to assemble and install a safety gate system correctly. Purchasers of such safety gates are required to handle the installation of said gate systems and may have to seek outside assistance from handymen or child home safety services in order to do so properly. Purchasers of such systems may attempt to assemble safety gate systems themselves, and do so incorrectly, resulting in a situation that could be more dangerous than having no safety gate in place at all.

The present invention addresses all of the above shortcomings by providing a novel method of installing and assembling a safety gate system that removes the burden of installation from the purchaser and places it in the hands of building and design professionals. The present invention further teaches a safety gate system for practicing said method comprising adapter features that are integrated within support structures such as a walls, doorframes, posts, banisters, railings, or newels. By providing adapter features, users are able to quickly and securely assemble and remove gates across passageways without the use of equipment or hardware.

SUMMARY OF THE INVENTION

The present invention relates to a novel safety gate system that may be specified by architects and builders comprising novel wall mount components that may be pre-installed in new construction. A barrier component of a safety gate system may be conveniently and securely assembled and removed by a user, without the need for tools, equipment, or hardware because the wall mounts are capable of securely, yet releasably attaching to the barrier component.

DETAILED DESCRIPTION OF THE PREFERRED EMBODIMENT OF THE PRESENT INVENTION

The present invention relates to a novel method of installing safety gate systems that allow occupants the ability to securely and conveniently assemble barriers across passageways without the need for tools or hardware. In the preferred practice of the method, architects, designers, or contractors specify with their clients beforehand locations where safety gates are desired in new construction. During the final phases of construction, adapter features are installed in designated passageways providing means to securely receive specialized units for forming barriers across passageways. Once moved into the new construction, occupants of the dwelling are able to assemble and remove a safety gate without the need for tools or hardware by attaching barrier-forming units to the pre-installed adapter features.

The method of the present invention is in contrast to prior art methods of installing safety gates where consumers are required to manage the installation of safety gates themselves in pre-existing dwellings. In order to secure safety gates in areas such as top of stair landings, prior art methods require the employment of tools, hardware, and require some level of skill. The present invention simplifies for occupants the process of assembling and removing safety gates by adapting new construction beforehand with the ability to receive components for forming a barrier.

Figure 1:
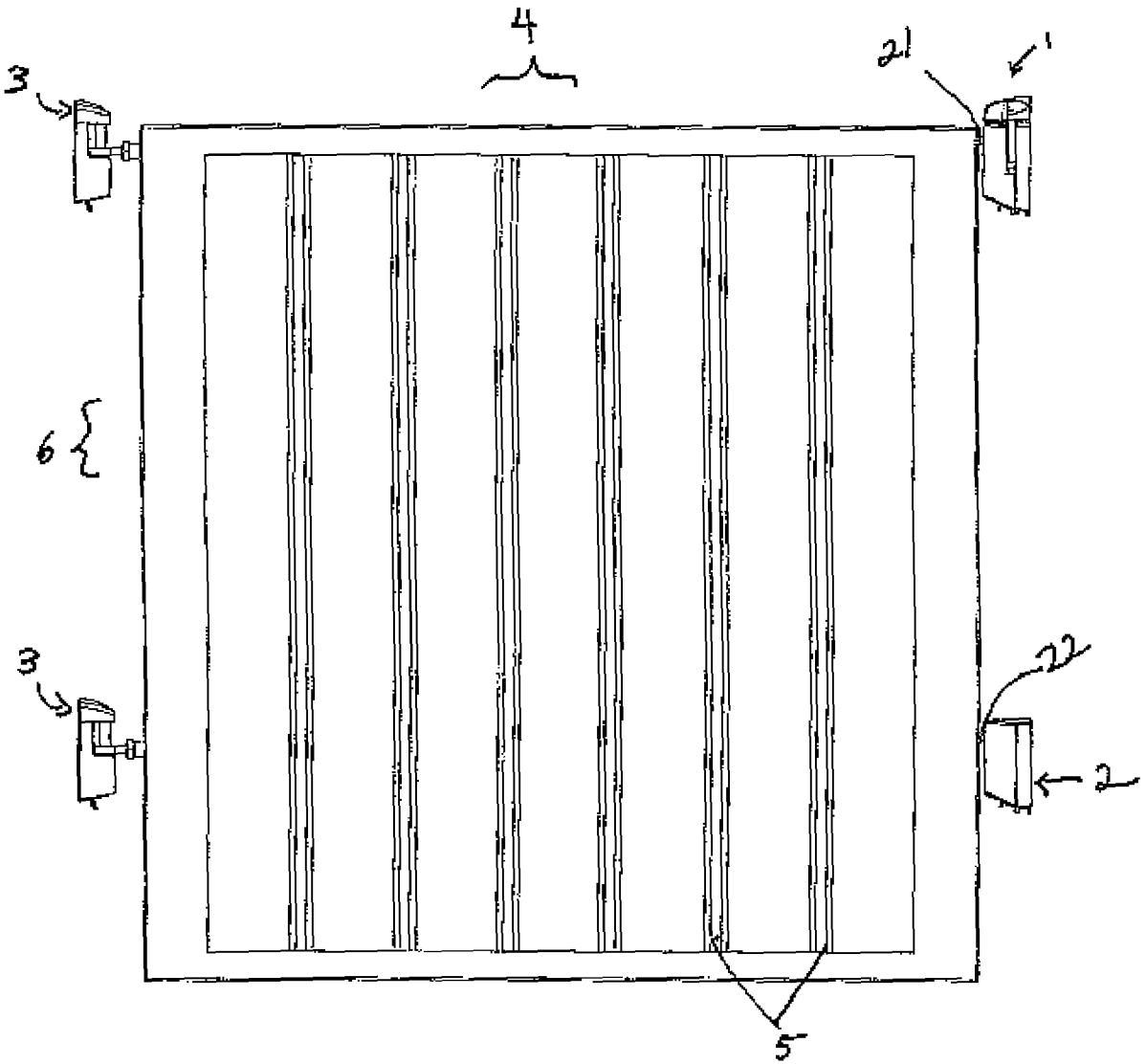
FIG. 1 is a planar view of the safety gate system assembled.

FIG. 1 depicts a planar view of an installed safety gate system for practicing the method of the present invention. The Figure illustrates an upper latch component 1, a lower latch component 2, multiple hinge components 3, and a barrier component 4.

The barrier component may comprise of rigid, vertical elements 5 which serve to limit access to a selected area. The vertical elements span a width sufficient so that access through a passageway by infants, children, or pets is prevented. Vertical elements may be constructed from wood, plastic, or metal according to the preferences of the user. Distances between vertical elements may vary depending on the needs of the user but should be spaced close enough so that an infant, toddler, or pet cannot pass through. Plastic or metal sheets may be added to provide an additional solid vertical element, or may be substituted in place of the vertical elements all together. Such variations may be made while still falling under the scope of the present invention.

On one vertical edge 6 of the barrier element are multiple hinge components 3. Said hinge components are securely fixed to the barrier component. The hinge components allow for the barrier component to be pivoted in a range of motions, from open to closed. The hinge components also allows for attachment of the barrier component to the wall mounts (not visible in FIG. 1) that are anchored to the support structure.

The upper latch component 1 is positioned directly opposite the topmost hinge component 3. Similar to the hinge components, the upper and lower latch components are attached to wall mount components (not visible in F*igure* 1), which are in turn anchored to a support structure. The latch components enable the barrier component to be locked into a closed position or released into an open position.

Figure 2:
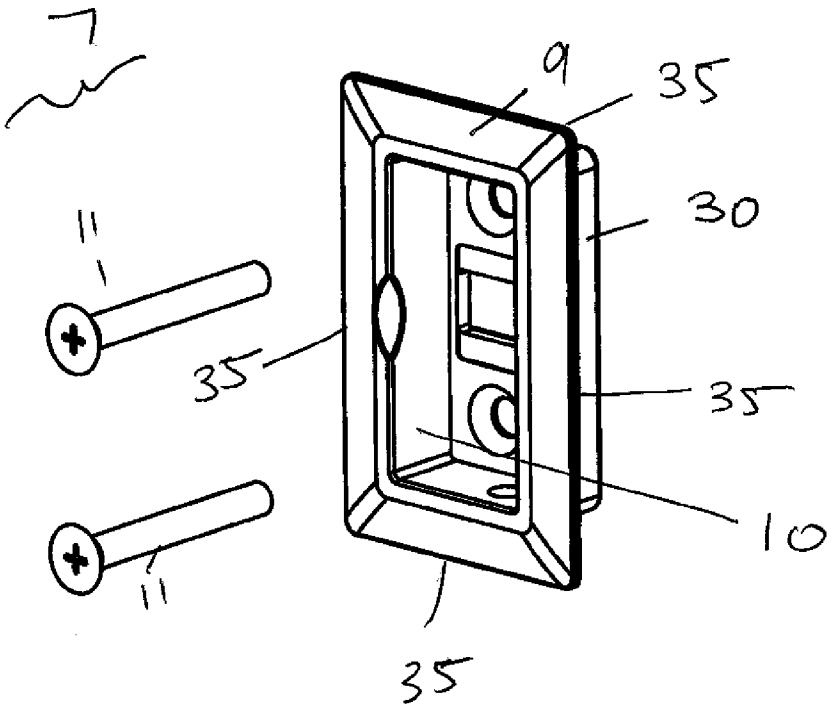
FIG. 2 is an exploded view of a wall mount component of the present invention.
Figure 2:
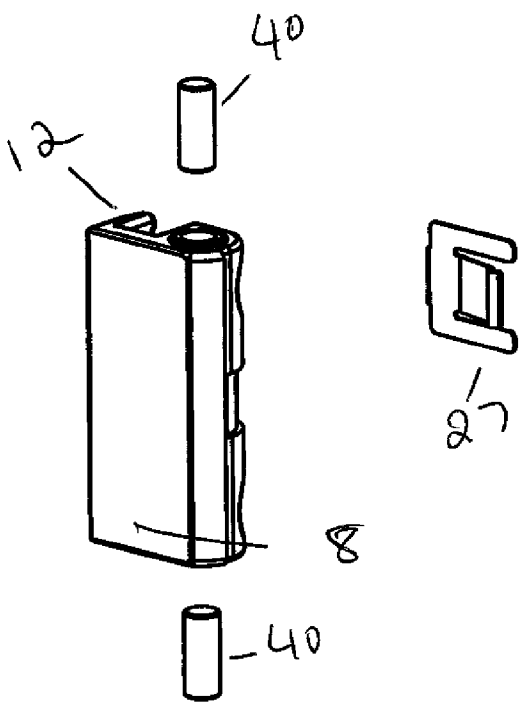
Figure 7:
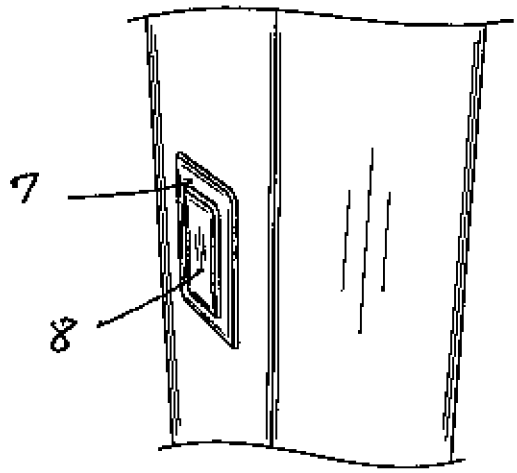
FIG. 7 shows a wall mount closed.
Figure 8:
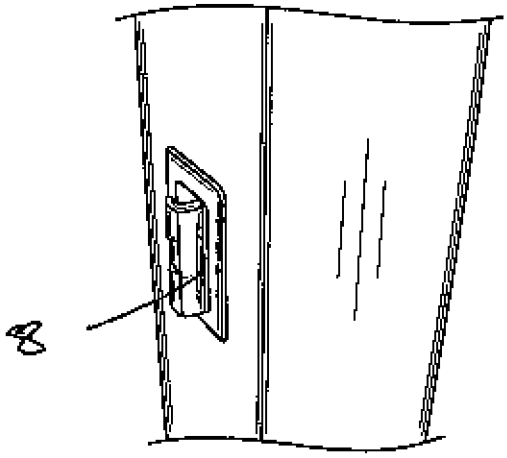
FIG. 8 shows a wall mount opened.
Figure 9:
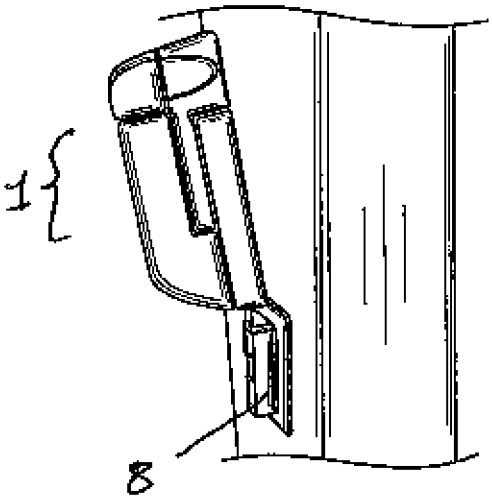
FIG. 9 shows a latch component being attached to an arm unit.

FIG. 2 depicts an exploded view of a wall mount 7. The wall mounts act as specialized outlets, capable of receiving hinge components 3 or latch components 1, 2 shown in FIG. 1. The wall mounts are comprised of an arm unit 8 and a panel unit 9. The panel unit is anchored within a support structure and has a hollow opening 10 to receive the arm unit. The area within the hollow opening of the panel unit is sufficient to hold the arm unit when folded into its dormant position. When installing the wall mounts within a support structure, a portion of the support structure is removed in order to receive a rear facing protrusion 30 of the wall mount. This enables the outermost edges of the wall mount 35 to lie flush against the support structure when installed, as is shown in FIGS. 7-9. The arm unit is attached to the panel unit through pivots 40, enabling the arm unit to pivot between an available position or dormant position, as shown in FIGS. 7-9. Bolts 11 or other attachment means may be used to secure the panel unit to a support structure. A spring tab 27 may be provided on the wall mount, in order to position the arm unit into either a dormant position or available position.

The arm unit 8 and panel unit 9 may be constructed from rigid and durable material such as plastic or metal and may be attached to the panel unit through pegs or other attachment means. When the arm unit is attached to the panel unit, the arm may be swung open and closed in either an available position or dormant position. In the available position, the arm is configured so that it may engage a hinge component or latch component. In the dormant position, the arm unit may be folded into the panel unit and rest within the hollow opening 10 of the panel unit, for a discreet and attractive appearance.

In the preferred method of practicing the present invention, the wall mounts are installed by builders during the construction phase of new dwellings. The use of the term "builders" is intended only as a general term and may include all trades capable of performing the installation including carpenters and millworkers. The wall mounts may be customized and constructed from a variety of materials and finishes according to the aesthetic preferences of the occupants. Plastic, metals, wood, and wood-laminates are representative materials that may be used in constructing the wall mounts.

Alternatively, the wall mounts and safety gate system of the present invention may also be installed in existing architecture, however this method is less convenient for the consumer than the preferred method of the invention.

Figure 3:
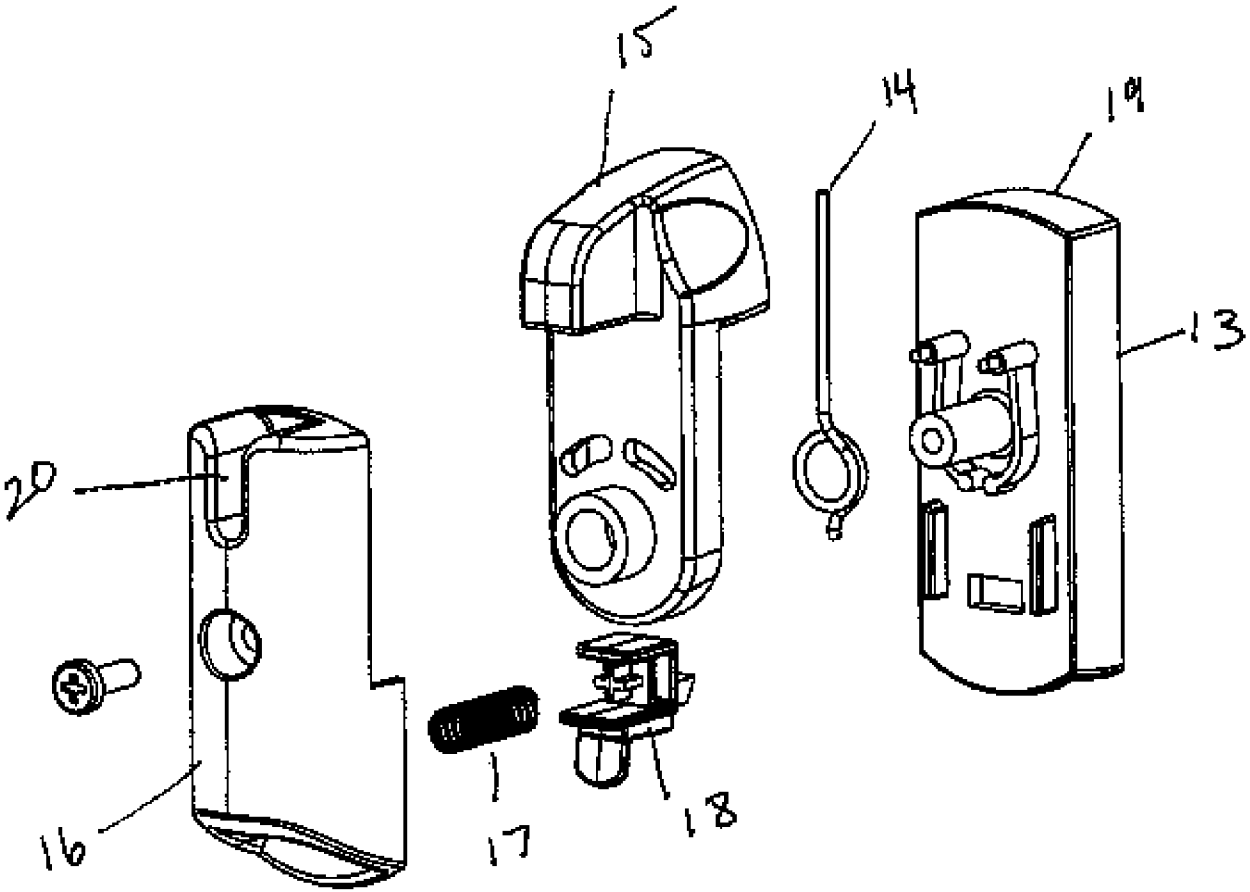
FIG. 3 is an exploded view of a latch component of the present invention.
Figure 4:
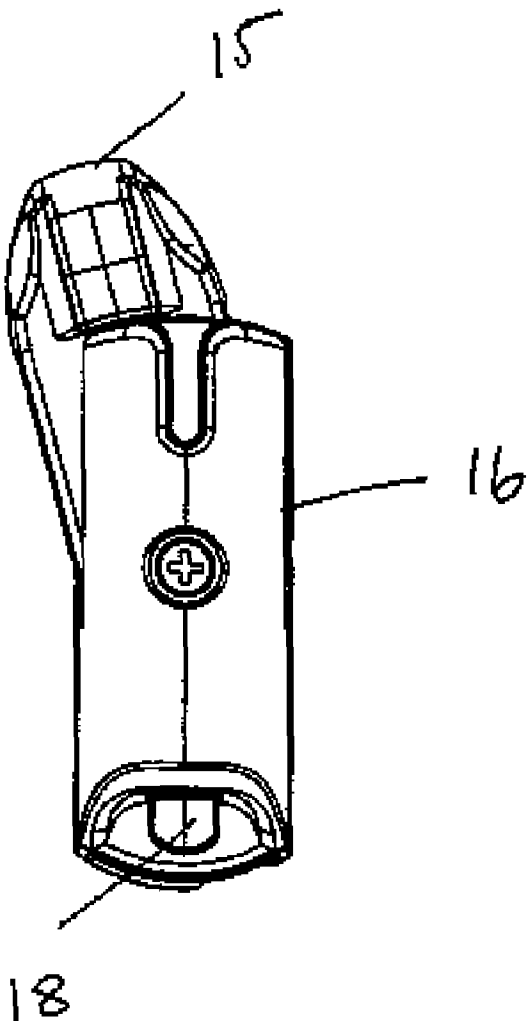
FIG. 4 is a planar view of the latch component in an unlocked position.

FIG. 3 depicts an exploded view of an upper latch component 1. The latch component comprises a frame 13, a pin 14, a lever 15, a cover 16, a spring 17, and a vertical lock 18. The frame 13 of the latch component comprises a groove 19 that allows it to be slid onto an arm unit 8 of a wall mount for easy attachment. The cover comprises a channel 20. The lever 15 serves to lock the gate in position and may be rotated, as shown in FIG. 4. The pin 14 keeps the lever in a centered position when the lever is not being rotated. The vertical lock 18 prevents vertical movement of the latch component when it is attached to a wall mount.

While FIG. 4 shows rotation of the lever in a counterclockwise direction, clockwise movement of the lever may also be performed. When the latch component is held in a locked position, the lever 15 lies directly above the channel 20, closing off the upper area of the channel. When the latch component is placed in an open position, the lever is rotated either in a clockwise, or counterclockwise direction, exposing the uppermost section of the channel, as pictured in FIG. 4.

Referring to FIG. 1, in conjunction with FIGS. 3-4, the locking mechanism of the barrier component may be understood. Shown in FIG. 1, an upper protrusion 21 and a lower protrusion 22 of the barrier component rests in channels located on the upper and lower latch components, holding the gate in a locked position. The lower protrusion may be held in a modified latch component that is identical to the upper latch component with the exception that it lacks the lever present in the upper latch component.

Referring to FIGS. 3 and 4, when the user wishes to release the barrier component from the locked position, the lever 15 of the upper latch component is rotated in either a clockwise or counter-clockwise direction. The channel 20 of the cover of the upper latch component is opened allowing the user to lift the barrier component in an upward direction, releasing the protrusions from the channels. The barrier component can be opened in either direction, either towards the user or away from the user. To return the barrier component into a locked position, the user simply lifts the barrier component and re-inserts the protrusions back into the channels of the upper and lower latch components.

Figure 5:
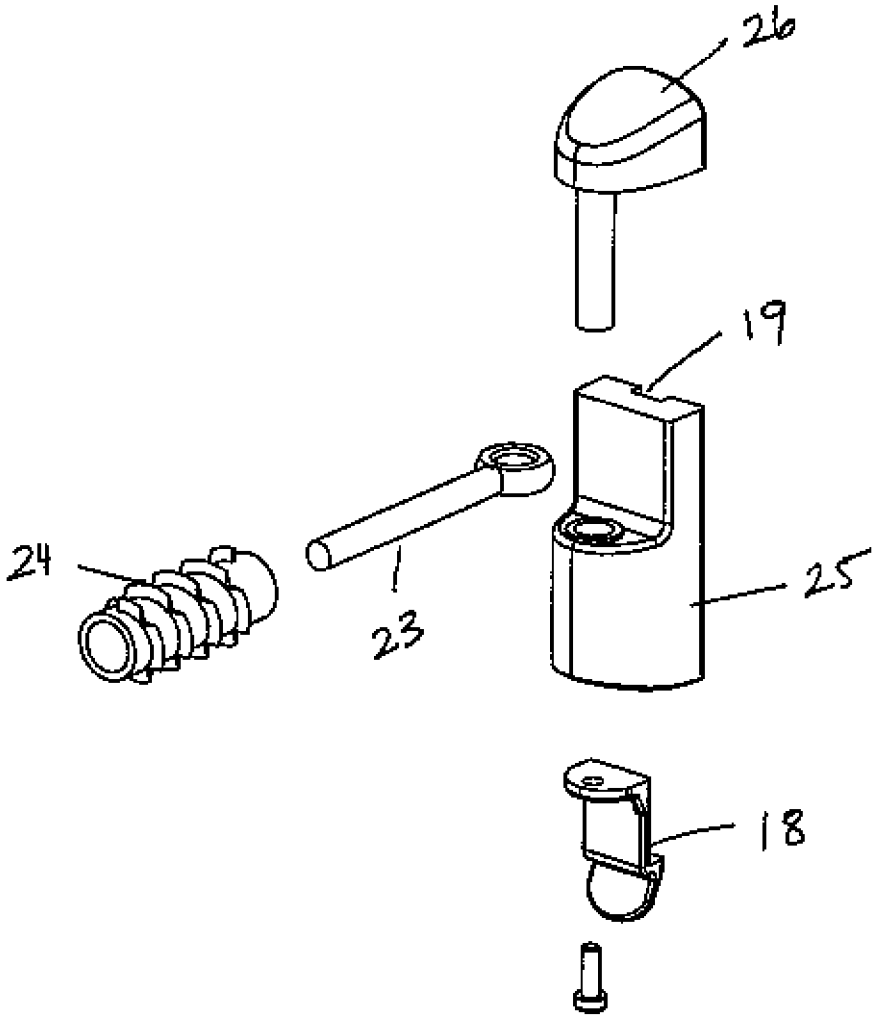
FIG. 5 is an exploded view of a hinge component of the present invention.

FIG. 5 depicts an exploded view of the hinge component 3 of the present invention. The hinge component comprises a hinge 23, a threaded bolt 24, a base 25, a cap 26, and a vertical lock 18. The threaded bolt is securely inserted into a barrier component (not shown in FIG. 5). The opposite end of the bolt is fastened to the hinge 23. The hinge is further secured between a base 25 and a cap 26. A vertical lock 18 is attached to the base that serves to prevent vertical movement of the hinge component when the hinge component is attached to a wall mount. A groove 19 is provided on the hinge component allowing for engagement with the arm of a wall mount component.

Figure 6:
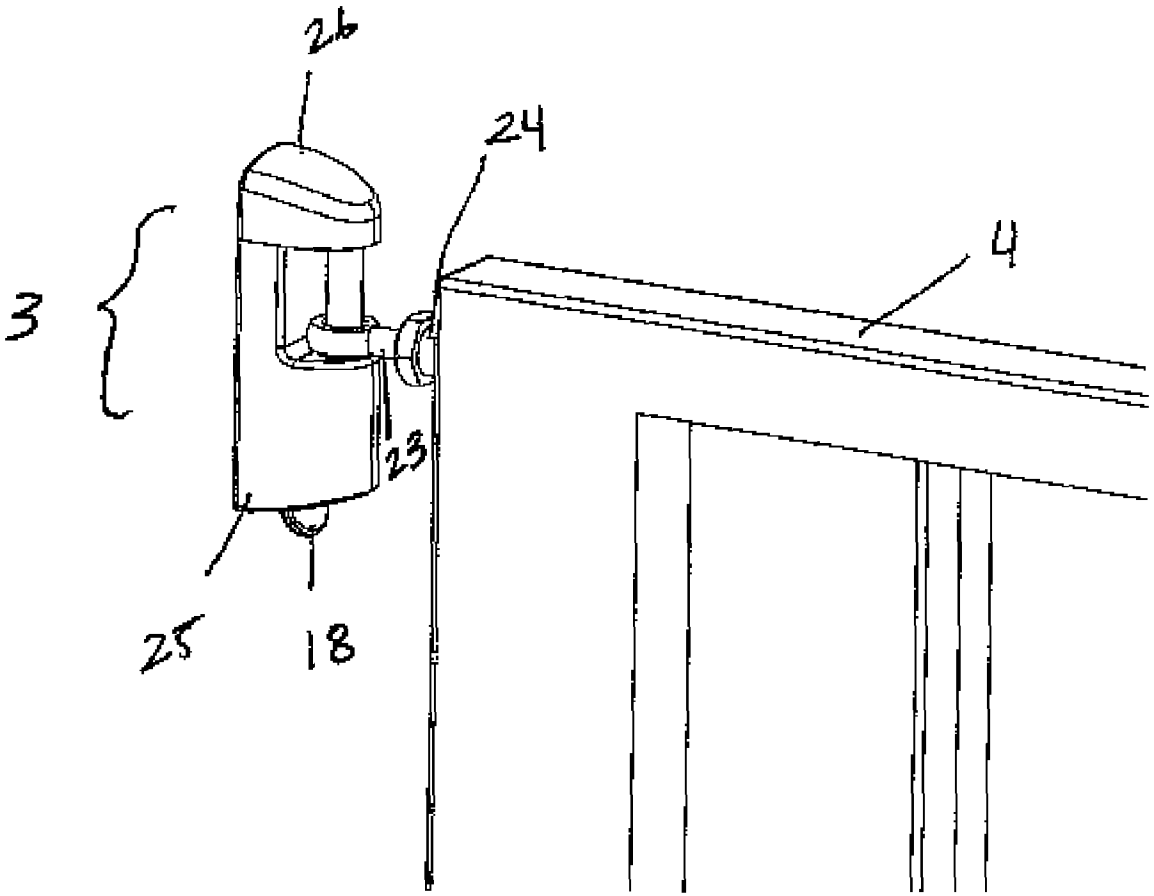
FIG. 6 is a perspective view of the hinge component and barrier component.

FIG. 6 depicts a perspective view of the hinge component 3 and barrier component 4. The hinge component allows for pivotal movement of the barrier component, bringing the barrier component from a closed position to an open position or an open position to a closed position. With the vertical lock placed in a locked position, movement of the hinge component in a vertical direction is prevented.

In order for the safety gate system to function properly, the barrier component should be properly aligned so that the protrusions 21, 22 of the barrier component may be inserted in the latch component. (See FIG. 1). Because the hinge component comprises a threaded bolt 24, fine tune adjustments may be made to the span of the barrier component by either screwing the threaded bolt towards the barrier component or away from the barrier component so that the barrier component and latch component are properly aligned.

Figure 10:
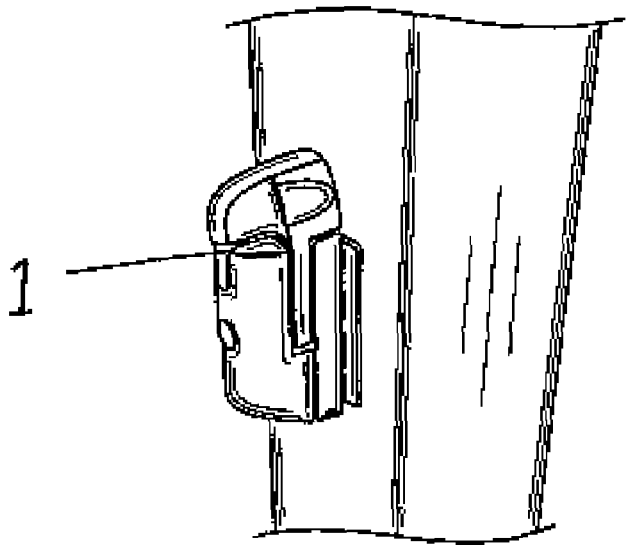
FIG. 10 shows a latch component securely attached to a wall mount.
Figure 11:
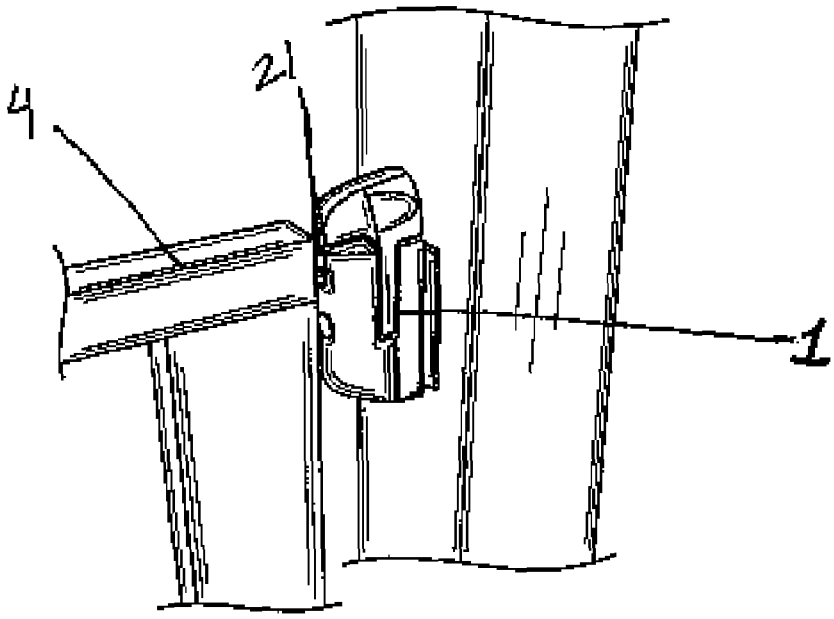
FIG. 11 shows a latch component with a barrier component in locked position.

FIGS. 7-11 illustrates the simplicity in attaching an upper latch component 1 to the wall mount. FIG. 7 shows the wall mount 7 with the arm 8 in a dormant position. The arm is folded into the hollow opening provided within the panel unit of the wall mount. In the dormant position, the arm unit is concealed and rests within the hollow opening of the wall mount. The arm unit no longer protrudes from the panel unit, but rather is housed within the panel unit. The outermost edges of the wall mount are flush with the surface of the support structure and there are no potentially dangerous protrusions projecting from the wall mount when in the dormant position. The appearance of the wall mount is discreet and attractive, and no fasteners such as attachment screws may be observed. FIG. 8 shows the arm unit swung opened in an available position. FIG. 9 shows a latch component being attached to the wall mount. A groove provided on the frame of the latch unit comprising the inverse shape of the arm unit allows for the frame to be securely slid onto the arm unit of the wall mount. Moving the latch in a downward direction, the latch is positioned into place. FIG. 10 shows the latch component locked into position, ready to receive the barrier component 4. FIG. 11 shows the barrier component 4 locked into position within the latch component.

For removal of the gate system, the vertical locks 18 on the hinge components and latch components are released and are separated from the wall mounts by sliding the components in an upward direction.

In summary, the present invention is a novel, inventive gate system that addresses many of the shortcomings in the art. With respect to the above description, it is to be realized that the optimum dimensional relationships for the parts of the invention, to include variations in size, materials, shape, form, function, manner and use are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, while still falling within the scope of the invention.

The invention claimed is:

1. A safety gate system for obstructing access by children and pets through a passageway comprising:

multiple wall mounts comprising an arm unit and a panel unit;

said panel unit comprises a rear facing protrusion and a corresponding hollow opening having an area sufficient to house the arm unit;

said arm unit further comprises pivots for attachment to said panel unit wherein said pivots enable said arm unit to assume either an available position or a dormant position;

in said dormant position, the arm unit is folded within the hollow opening of the panel unit;

in said available position, the arm unit is swung open and protrudes from said panel unit;

a hinge component, wherein said hinge component comprises a groove enabling said hinge component to be removably attached to said arm unit;

a barrier component, wherein said barrier component is attached to said hinge component through a threaded bolt; and a latch component, wherein said latch component comprises a groove enabling said latch component to be removably attached to said arm unit.

2. A method for installing the wall mount of the safety gate system of claim 1 comprising the following steps:

removal of a portion of a support structure at least equal to the dimensions of the rear facing protrusion of the panel unit of the wall mount;

insertion of the rear facing protrusion of the panel unit of the wall mount within the removed portion of the support structure; and attachment of the wall mount to the support structure through fastener means.

* * * * *